United States Patent [19]

Cote

[11] Patent Number: 4,570,932

[45] Date of Patent: Feb. 18, 1986

[54] HOCKEY STICK HAVING WEDGE INSERT IN THE BLADE

[76] Inventor: George R. Cote, 339 Huntbourne Hill N.E., Calgary, Alberta, Canada, T2K 3Y5

[21] Appl. No.: 603,183

[22] Filed: Apr. 23, 1984

[30] Foreign Application Priority Data

Apr. 28, 1983 [CA] Canada ..... 426963

[51] Int. Cl.[4] ..... A63B 59/14

[52] U.S. Cl. ..... 273/67 A

[58] Field of Search ..... 273/67 R, 67 A, 67 D, 273/67 DC; D21/210-213

[56] References Cited

U.S. PATENT DOCUMENTS 4,452,451 6/1984 Dubreuil ..... 273/67 A

FOREIGN PATENT DOCUMENTS 5224 of 1926 Australia ..... 273/67 DC 2098076 11/1982 United Kingdom ..... 273/67 D

*Primary Examiner*—Richard C. Pinkham

*Assistant Examiner*—Matthew L. Schneider

*Attorney, Agent, or Firm*—Harold H. Dutton, Jr.; George H. Dunsmuir

[57] ABSTRACT

A blade for an ice hockey stick includes a wedge in the outer free end thereof, so that the front surface of the blade is curved and the rear surface is straight. Such a structure provides the forehand advantages of a curved blade and facilitates the backhand shot. By using a soft wedge which extends outwardly a short distance beyond the outer edge of the blade the possibility of a stick related injury is reduced.

5 Claims, 3 Drawing Figures

HOCKEY STICK HAVING WEDGE INSERT IN THE BLADE

BACKGROUND OF THE INVENTION

This invention relates to a hockey stick and in particular to a blade for an ice hockey stick.

For the sake of simplicity the expression "hockey stick" will be used hereinafter to identify an ice hockey stick.

The vast majority of hockey sticks at present being produced are curved for achieving the best results when shooting forehand. Unfortunately the use of a curved stick adversely affects the backhand shot because the puck is more likely to slide off a curved rear surface than a straight surface. Canadian Pat. No. 850,516 which issued to F. E. Dawe on Sept. 1, 1970 discloses a hockey stick designed to overcome the above mentioned curved stick problem. The Dawe's stick includes a shoulder extending in the backhand direction at the toe end of the blade. It is readily apparent that the Dawe's stick would be relatively expensive to produce, requiring either a special mold or extensive woodworking.

The object of the present invention is to provide a relatively simple hockey stick which is easy to produce.

BRIEF SUMMARY OF THE INVENTION

Accordingly the present invention relates to a hockey stick blade comprising an elongated substantially rectangular body normally integral with the bottom end of a handle; and a wedge in the outer free end of said body, said wedge extending into said body a distance sufficient to cause a front surface of said blade to curve, the rear surface of said blade being substantially straight.

BRIEF DESCRIPTION OF THE DRAWINGS

The invention will now be described in greater detail with reference to the accompanying drawing, which illustrates a preferred embodiment of the invention and wherein.

BRIEF DESCRIPTION OF PREFERRED EMBODIMENT

Figure 1:
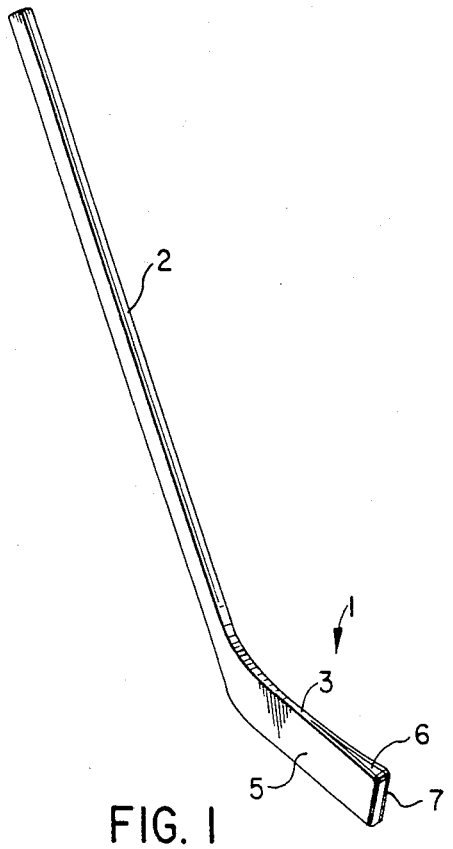
FIGS. 1 and 2 are schematic perspective views of a hockey stick with a blade in accordance with the present invention.
Figure 2:
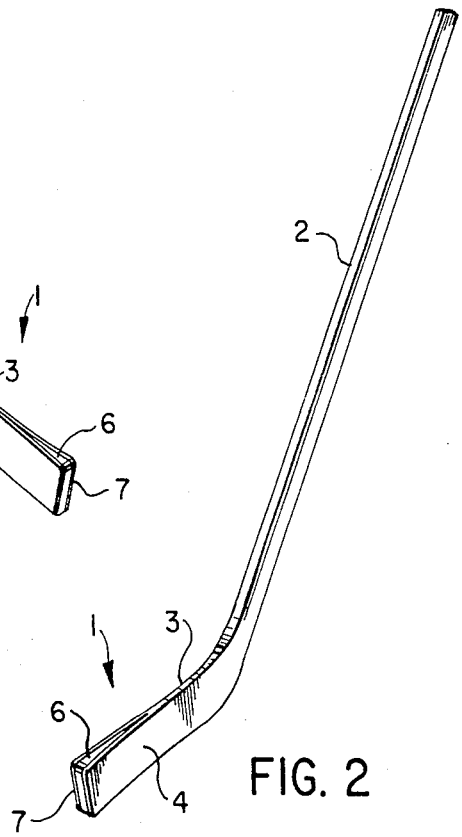
Figure 3:
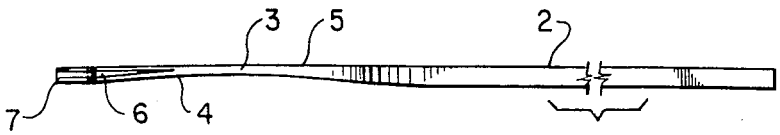
FIG. 3 is a plan view of the hockey stick of FIGS. 1 and 2.

With reference to the drawing, the blade of the present invention, which is generally indicated at 1, is normally integral with a handle 2 to define a conventional hockey stick. It will be appreciated that the blade 1 can be separate from the handle 2, i.e. the blade can be of the replaceable type and still be constructed in accordance with the teachings of the present invention.

The body 3 of the blade 1 is generally rectangular when viewed from the front or rear and is formed of wood or plastic and includes a front surface 4 and a rear surface 5. It will be appreciated that the hockey stick shown in the drawing is a righthand stick and that the present invention can also be used with lefthand sticks.

A wedge 6 is provided in the outer free end 7 of the body 3. The wedge 6 extends into the body 3 at a distance sufficient to cause the front surface 4 to curve, while the rear surface 5 is straight. The wedge 6 is flush with the top and outer end 7 of the body 3. The wedge 6 is formed of any suitable material such as rubber or plastic and may have the same or a different hardness from the body 3. In order to reduce stick related injuries the wedge 6 can be formed of a softer material than the body material and the wedge can extend outwardly beyond the top edge and/or outer end 7 of the body. Thus, when a player is hit by the end of the stick the possibility of being cut by the hard end of the body 3 is reduced.

A hockey stick incorporating the blade described hereinbefore is used in the same manner as a conventional hockey stick. It is obvious that even though the front surface of the stick is curved, the backhand shot should not be adversely affected, because the rear surface of the blade is straight.

What I claim is:

1. An ice hockey stick comprising an elongated shaft portion and an elongated generally rectangular blade portion extending from one end of said shaft portion and terminating at a distal end said blade portion having separate wedge means located within said blade portion at the distal end thereof; said wedge means providing a curved front hitting surface while at the same time maintaining a straight rear hitting surface on said blade.

2. A hockey stick according to claim 1, wherein said wedge means is formed of a material softer than the material forming said body.

3. A hockey stick according to claim 2 wherein said wedge means extends outwardly beyond the distal end of said blade portion.

4. A hockey stick according to claim 1, wherein said wedge means is formed of the same material as the blade.

5. A hockey stick according to claim 1, wherein said wedge means is formed of a plastic material.

* * * * *